US007845639B2

(12) United States Patent
Lyga et al.

(10) Patent No.: US 7,845,639 B2
(45) Date of Patent: Dec. 7, 2010

(54) MULTI-FUNCTION LOW PROFILE PRINT INTERFACE FOR A SHEET HANDLING DEVICE

(75) Inventors: Thomas M. Lyga, Southbury, CT (US); Aaron D. Smith, Beacon Falls, CT (US); Robert J. Allen, Shelton, CT (US); James A. Fairweather, Milford, CT (US); Neil F. Baldino, Sandy Hook, CT (US)

(73) Assignee: Pitney Bowes Inc., Stamford, CT (US)

( * ) Notice: Subject to any disclaimer, the term of this patent is extended or adjusted under 35 U.S.C. 154(b) by 784 days.

(21) Appl. No.: 11/731,298

(22) Filed: Mar. 30, 2007

(65) Prior Publication Data

US 2008/0185771 A1 Aug. 7, 2008

Related U.S. Application Data

(60) Provisional application No. 60/899,594, filed on Feb. 5, 2007, provisional application No. 60/899,558, filed on Feb. 5, 2007.

(51) Int. Cl.
*B65H 39/10* (2006.01)

(52) U.S. Cl. ..... 271/303; 271/176; 271/298

(58) Field of Classification Search ..... 271/176, 271/298, 303; 399/124, 110
See application file for complete search history.

(56) References Cited

U.S. PATENT DOCUMENTS 3,661,383 A * 5/1972 Morrison ..... 271/273
5,280,331 A * 1/1994 Namiki ..... 399/124
5,337,134 A * 8/1994 Sato et al. ..... 399/124
5,517,281 A * 5/1996 Miyashiro et al. ..... 399/124
5,579,098 A * 11/1996 Noguchi et al. ..... 399/122
6,308,952 B1 * 10/2001 Takagi et al. ..... 271/297
6,332,611 B1 * 12/2001 Tomita ..... 271/273
6,804,473 B2 * 10/2004 Nakamura et al. ..... 399/16
7,467,794 B2 * 12/2008 Kubota et al. ..... 271/303
2003/0116911 A1 * 6/2003 Kanai ..... 271/303
2003/0235430 A1 * 12/2003 Koshida ..... 399/124
2007/0092293 A1 * 4/2007 Jang ..... 399/124
2007/0205552 A1 * 9/2007 Taniguchi ..... 271/303

* cited by examiner

*Primary Examiner*—Patrick Mackey
*Assistant Examiner*—Prasad V Gokhale
(74) *Attorney, Agent, or Firm*—Brian A. Collins; Angelo N. Chaclas

(57) ABSTRACT

A print interface system includes a printer integrated in combination with a sheet handling system such as a mailpiece inserter. The print interface system facilitates the handling of sheet material in various operating modes, including conventional printing, duplex printing, and mailpiece creation modes. The system includes an interface module having upper and lower housing segments defining first and second feed paths. A first feed path directs sheet material to a stacking surface of the upper housing segment and a second feed path directs sheet material to a downstream module of the sheet handling device. A repositionable diverter bifurcates the path exiting the printer to direct sheet material to one of the two feed paths. Furthermore, the upper housing segment is pivotally mounted to the lower housing segment to provide internal access to one of the first and second feed paths.

13 Claims, 7 Drawing Sheets

MULTI-FUNCTION LOW PROFILE PRINT INTERFACE FOR A SHEET HANDLING DEVICE

CROSS REFERENCE TO RELATED APPLICATIONS

This application claims the benefit of U.S. Provisional Patent Applications 60/899,594 and 60/899,558 which were filed on Feb. 5, 2007. The specification of each provisional application is hereby incorporated by reference.

TECHNICAL FIELD

The present invention relates to systems for integrating a printer with accessory equipment, and, more particularly, to a system for integrating a printer with a sheet handling device and, still more particularly, a print interface system for performing conventional print operations in addition to printing content material on demand for use by a downstream module of a sheet handling device.

BACKGROUND OF THE INVENTION

A mail insertion system or a "mailpiece inserter" is commonly employed for producing mailpieces intended for mass mail communications. Such mailpiece inserters are typically used by organizations such as banks, insurance companies and utility companies for producing a large volume of specific mail communications where the contents of each mailpiece are directed to a particular addressee. Also, other organizations, such as direct mailers, use mailpiece inserters for producing mass mailings where the contents of each mailpiece are substantially identical with respect to each addressee.

In many respects, a typical inserter system resembles a manufacturing assembly line. Sheets and other raw materials (i.e., a web of paper stock, enclosures, and envelopes) enter the inserter system as inputs. Various modules or workstations in the inserter system work cooperatively to process the sheets until a finished mail piece is produced. Typically, inserter systems prepare mail pieces by arranging preprinted sheets of material into a collation, i.e., the content material of the mail piece, on a transport deck. The collation of preprinted sheets may continue to a chassis module where additional sheets or inserts may be added based upon predefined criteria, e.g., an insert being sent to addressees in a particular geographic region. Subsequently, the collation may be folded and placed into envelopes. Once filled, the envelopes are closed, sealed, weighed, and sorted. A postage meter may then be used to apply postage indicia based upon the weight and/or size of the mail piece.

These inserters typically require the use of "preprinted" sheets which are presented to the various downstream devices by a feed module for subsequent processing. That is, a mailpiece job run is printed to produce an "ordered" stack of mailpiece content material which may be fed to the mailpiece inserter. Scan codes disposed in the margin of the first or last sheet of each mailpiece document provide the instructions necessary to process the mailpiece, i.e., whether additional inserts will be added, how the content material is to be folded (C-fold, Z-fold, etc.) and/or what size envelop will the content material be contained. To facilitate communication of these instructions, a user computer and a printing device are typically network connected to the mailpiece inserter such that scan codes can be easily printed and interpreted.

More recently, printers have been integrated with mailpiece inserters so that mailpiece content material may be supplied "on-demand", and/or "just-in-time". Examples of inserters having integrated printers include the DI 900 and DI 950 mailpiece inserters manufactured by Pitney Bowes Inc., located in Stamford, Conn. While such integration facilitates the flow and handling of mailpiece content material, it is often desirable, if not essential, that the printers used in such mailpiece inserters be repairable, replaceable or interchangeable with other printers. For example, while the DI 900 and DI 950 inserters employ HP 4350 B&W and HP 4700 color printers, it may, over the course of many years of service, be desirable to substitute these printers with updated versions of the same or to replace these printers with those of other Original Equipment Manufactures (OEMs).

Inasmuch as the internal program code employed to control such printers is often proprietary/confidential to the OEM, or time consuming to modify, it has become increasingly important to develop an electromechanical interface between the printer and inserter which allows the printer to operate independently while at the same time operate harmoniously with the mailpiece inserter. That is, the printer must be operative to perform its various functions, including those required by the inserter, without modifying the internal program code of the base printer.

Examples of such program functions include the requirement to duplex print (dual-sided printing) and conventional printing to an upper stacking tray. With respect to the former, duplex printing produces unique requirements inasmuch as a diverter mechanism, typically used in conjunction with printer accessories (such as a stapler or collator), must be controlled to divert sheet material to the mailpiece inserter. That is, while the diverter is typically controlled by the internal printer program code, i.e., when an accessory is added, the diverter must now be controlled in accordance with a different set of algorithms to cooperate with the inserter. With respect to the latter, the printer must be controlled to send sheet material to a stacking tray when being operated as a conventional printing apparatus and to a downstream module of the inserter (typically referred to as the buffer/accumulator or input module) when being used to generate mailpieces.

Additionally, when integrating print devices (i.e., such as the integration of mailpiece inserters with sheet handling equipment), difficulties often arise due to the subsequent height and/or weight of the stacked sheet material. That is, the initial height of the printing device in combination with the height of the accumulated sheet material can result in a total height which is difficult, i.e., ergonomically, to reach and manipulate.

A need, therefore, exists for a print interface system for a sheet handling system which is low profile to facilitate handling of stacked sheet material and accommodates both conventional printing and mailpiece creation modes of operation.

SUMMARY OF THE INVENTION

A print interface system is disclosed, including a printer integrated in combination with a sheet handling system such as a mailpiece inserter. The print interface system facilitates the handling of sheet material in various operating modes, including conventional printing, duplex printing, and mailpiece creation modes. The system includes an interface module having upper and lower housing segments defining first and second feed paths. A first feed path directs sheet material to a stacking surface of the upper housing segment and a second feed path directs sheet material to a downstream module of the sheet handling device. A repositionable diverter bifurcates the path exiting the printer to direct sheet material to one of the two feed paths. Furthermore, the upper housing segment is pivotally mounted to the lower housing segment to provide internal access to one of the first and second feed paths.

BRIEF DESCRIPTION OF THE DRAWINGS

The accompanying drawings illustrate a presently preferred embodiment of the invention, and together with the general description given above and the detailed description given below, serve to explain the principles of the invention. As shown throughout the drawings, like reference numerals designate like or corresponding parts.

BEST MODE TO CARRY OUT THE INVENTION

The inventive print interface system and control algorithms therefor are described in the context of a mailpiece inserter system, though the inventive interface system may be used in combination with any sheet handling device which requires printing "on-demand" or "on request". Further, the invention is described in the context of a DI 900 Model Mailpiece Inserter, i.e., a mailpiece creation system produced by Pitney Bowes Inc., located in Stamford, State of Connecticut, USA, though the inventive subject matter may be employed in any mailpiece inserter and/or with any print manager software used in the printing/creation of mailpieces, such as PBFirst®. PBFirst is a registered trademark of Pitney Bowes Inc. and is a software product for printing/producing mailpieces processed by a mailpiece inserter system. Moreover, while the print interface system and control algorithms thereof are intended for use in combination with printers of various makes and models, the printers described herein include the HP 4350 BW and HP 4700 Color printers manufactured by Hewlett Packard Company, located in Palo Alto, State of California, U.S.A.

Figure 1:
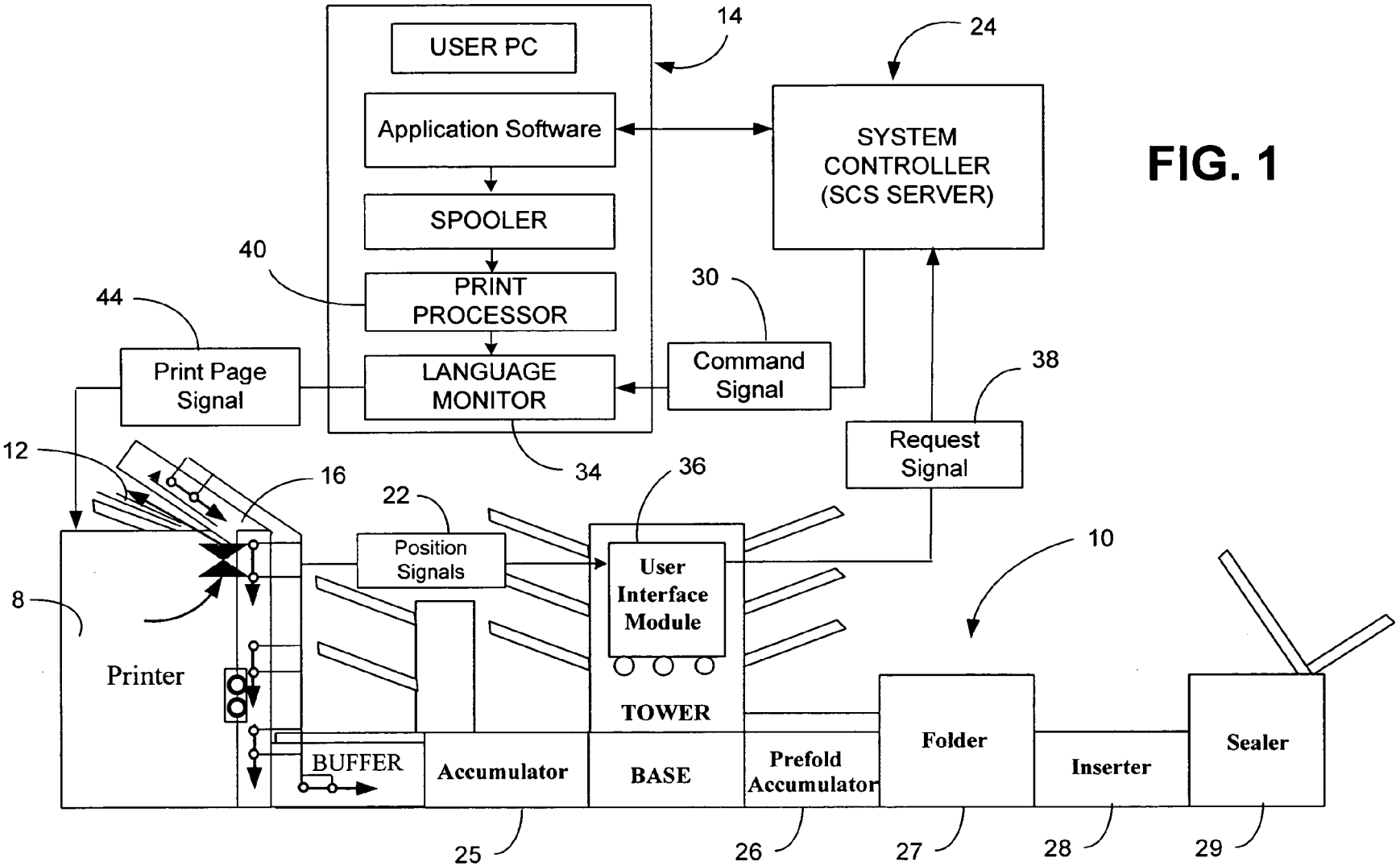
FIG. 1 is a schematic diagram of a mailpiece inserter having a printer integrated upstream of the various mailpiece handling/processing modules, i.e., a mechanical page buffer/accumulator, folder, inserter, and sealer.

Before discussing the invention in greater detail, it will be useful to understand the basic system architecture and operation of the mailpiece inserter, including the cooperation of various system components and elements. In FIG. 1, a dedicated printer 8 is integrated with the mailpiece inserter 10 and is disposed upstream of various inserter devices (also referred to as downstream devices relative to the printer 8) which handle and process the mailpiece content material 12. Throughout the description, the terms "mailpiece content material", "printed material", "sheets" and/or "sheet material" will used interchangeably. In the described embodiment, an HP 4350 and HP 4700 model printer, manufactured by Hewlett Packard (HP), is integrated with the mailpiece inserter 10. The HP 4350 printer system is a black & white printer having an output rate of approximately fifty-five (55) pages per minute. The HP 4700 is a color printer having an output rate of approximately thirty (30) pages per minute.

Figure 2:
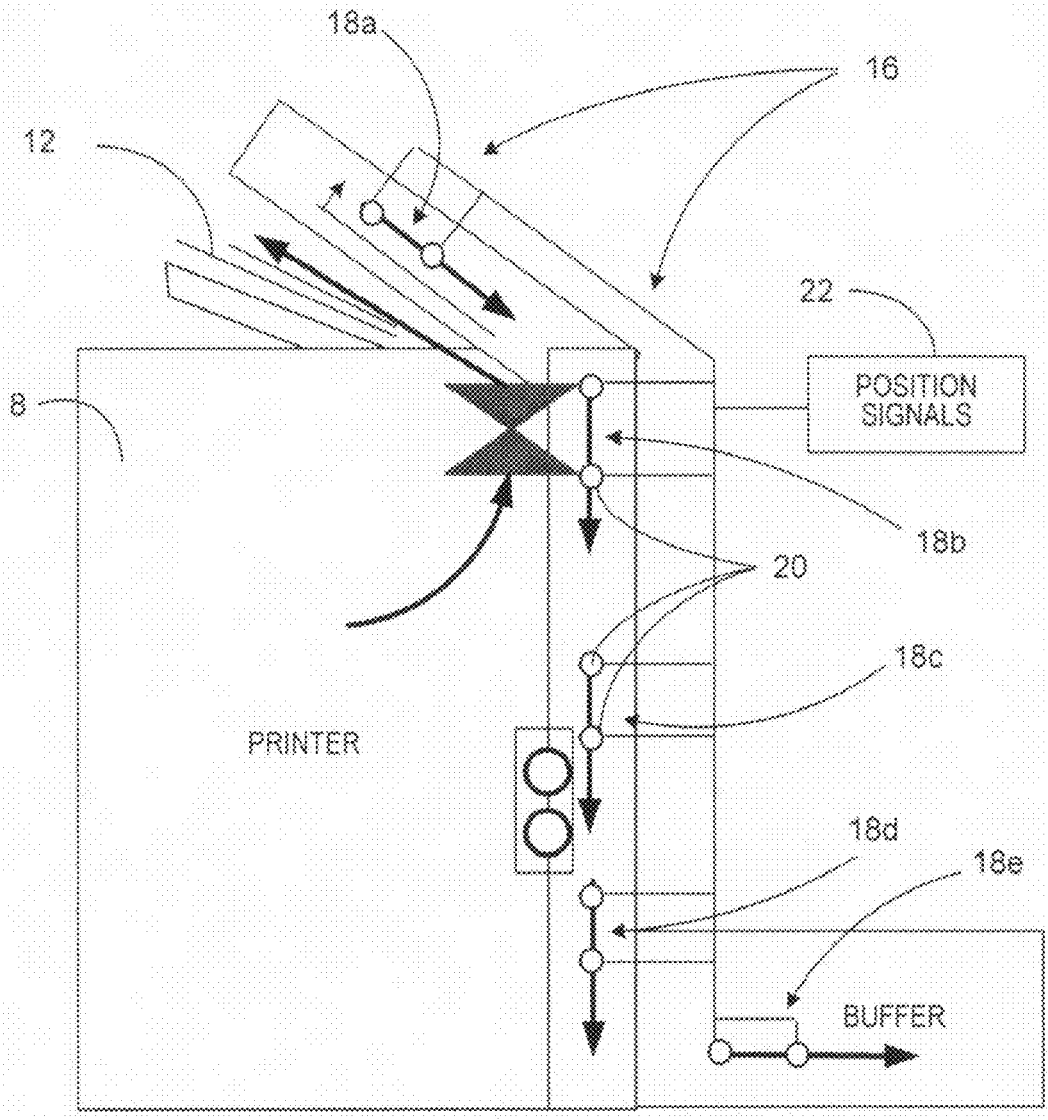
FIG. 2 is an enlarged schematic diagram of a mechanical printed-page buffer which senses the throughput status of mailpiece content material prior to downstream processing by the inserter.

In FIGS. 1 and 2, a mechanical buffer or page buffer 16 is disposed downstream of the printer 8 and, inter alia, functions to monitor/track the throughput of printed pages 12 being processed by the mailpiece inserter 10. More specifically, the page buffer 16 receives printed pages 12 from the printer 8 and includes a plurality of sequential page stations 18*a*, 18*b*, 18*c*, 18*d*, 18*e* disposed along a serial feed path. Position sensing devices 20 are located at or along each of the page stations 18*a*, 18*b*, 18*c*, 18*d*, 18*e* and monitor the rate that printed pages enter or leave the page buffer 16. Furthermore, the sensing devices 20 are operative to issue position signals 22 to a system controller 24 such that the inserter 10 may determine whether a page or sheet 12 is positioned at a particular one of the page stations 18*a*, 18*b*, 18*c*, 18*d*, 18*e*. In the described embodiment, the sensing devices 20 are photocells, though any position sensor 20 may be employed.

The rate of change of the position signals 22 (i.e., the signals issued by the page buffer 16) may be used by the controller 24 to determine the rate at which the throughput of the content material 12 is processed. Fundamentally, the "throughput" or "throughput rate" is the magnitude at which sheet material 12 is processed, whether in terms of a steady number of "sheets per unit time", bundles of sheets (e.g., bundles of five (5) sheets requested every several seconds) or a non-steady flow of sheets. Generally, it is the objective of the system controller 24 to drive the printer 8 to generate content material 12 at a rate consistent, or commensurate, with the rate of processing by other downstream devices of the mailpiece creation system 10. While in the described embodiment the initial/first downstream device is a page buffer 16, it should be appreciated that any downstream device may be adapted to issue a throughput signal indicative of the rate that content material 12 or mailpieces are processed by the inserter 10. In FIG. 1, such downstream devices may additionally, or alternatively, include an accumulator 25, a pre-fold accumulator 26, a folder 27, an envelop inserter 28, and/or a sealer 29.

The system controller 24 monitors the throughput data and issues command signals 30 indicative of the number of pages 12 to be printed by the integrated printer 8. More specifically, the command signals 30 are indicative of a specific page number to begin printing along with the number of pages 12 to follow. For example, the controller 24 may issue command signals 30 requesting the printer 8 to generate page number thirty (Page #30) plus five (5) additional pages of data. Before this request is issued to the printer (in the more conventional sense), the controller 24 issues the command through a page-based language monitor 34. In the preferred embodiment, the system controller 24 generally issues a command signal 30 to print between three (3) to seven (7) pages with each request, though several command signals 30 may be generated within a very short period of time.

The mailpiece inserter 10 further includes a User Interface Module (UIM) 36 interposing the mechanical page buffer 16 and the system controller 24. The UIM 36 is responsive to the position signals 22 of the mechanical page buffer 16 for determining when additional pages, sheets or content material 12 can be accepted by the page buffer 16. Furthermore, the UIM 36 is operative to issue a request signal 38 to the system controller 24, which request signal 38 is indicative of the number of mailpiece content pages 12 to be printed. Hence, conversion of the position signals 22 to a command signal 30 may be performed by either the system controller 24 or by the UIM 36, depending upon where the program logic/intelligence is located. It should be further appreciated that while a request may be made by the UIM 36, the controller 24 may have received a message that the print job, i.e., determined at the User PC 14, is complete. Consequently, in this instance, the controller 24 will not forward a command signal 30 to the language monitor 34 for issuance to the printer 8.

The page-based language monitor 34 (hereinafter the "language monitor" or "LM") receives print stream data from a page-based print processor 40 and is interposed between the system controller 24 and the dedicated printer 8. In the broadest sense, the LM 34 is the gate-keeper of data communicated to the printer 8 from the controller 24. More specifically, the LM 34 retains material content data, including an object-data dictionary, for each page of material content and triggers the printer 8 to generate a particular page (i.e., page number) along with N number of additional pages. While this request to print is made by the controller 24, the LM 34 contains the active program code which intercepts the print stream data, i.e., the print control language (PCL), from the printer driver to throttle the rate at which content material 12 is generated by the printer 8.

More specifically, the page-based LM 34 is operative to vary the flow of print stream data to the printer 8 and vary the production rate of mailpiece content material. Additionally, the LM 34 includes a buffer file capable of storing 300 MB (300,000,000 bytes) of data and, accordingly, the buffer file is capable of storing multiple pages of data, including duplex pages. Hence, in the context used herein, a "page" of data includes all data which may be found on a one or two-sided sheet of paper.

In operation, the LM 34 and print processor 40 issue a print command signal 44 to throttle/control the output of the printer in order to be consistent with or match the throughput of the mailpiece inserter 10. As more pages are processed by the inserter 10, additional or more frequent requests for additional printed pages can be made. Should the inserter 10 require additional processing time to collate and/or combine a complex variety of inserts, requests can be made for a fewer number of printed pages or at less frequent intervals to prevent an overload condition or too many sheets from being printed over a prescribed period of time.

Printer Integration/Print Interface

When integrating a printer with a sheet handling device such as a mailpiece creation system/inserter, several requirements and objectives should be met/obtained. First, to ensure maximum throughput, the system should minimize time gaps between a request for printing and the generation of printed content material. Secondly, to the extent that various application software may be employed to generate print jobs, it is desirable to affect integration of the printer without modifying its underlying print program code. As mentioned in the Background of the Invention, aside from the cost associated with program code modification, such program code is oftentimes proprietary to the original equipment manufacturer (OEM). Consequently, it may be difficult to obtain access to or overwrite the original program code.

Additionally, the printer throughput and/or operation should not be adversely impacted when performing specialized functions such as duplex printing. As will be discussed hereinafter, some printers feed duplex-printed pages to an upper output tray rather than to an accessory feed path. Inasmuch as certain sheet handling equipment, such as certain mailpiece inserters, receive printed pages from an accessory feed path, various control and/or feed path modifications must be performed without impacting throughput or creating new/additional modes of failure. Finally, inasmuch as such high-output printers are costly pieces of capital equipment, it is oftentimes necessary that the printer be used in multiple modes to justify/amortize the original investment. Consequently, the printer may necessarily include a suitable interface to operate both independently and in conjunction with the sheet handling device. These requirements/objectives are discussed and met in the subsequent description.

Duplex Printing/Control Algorithm

Figure 3:
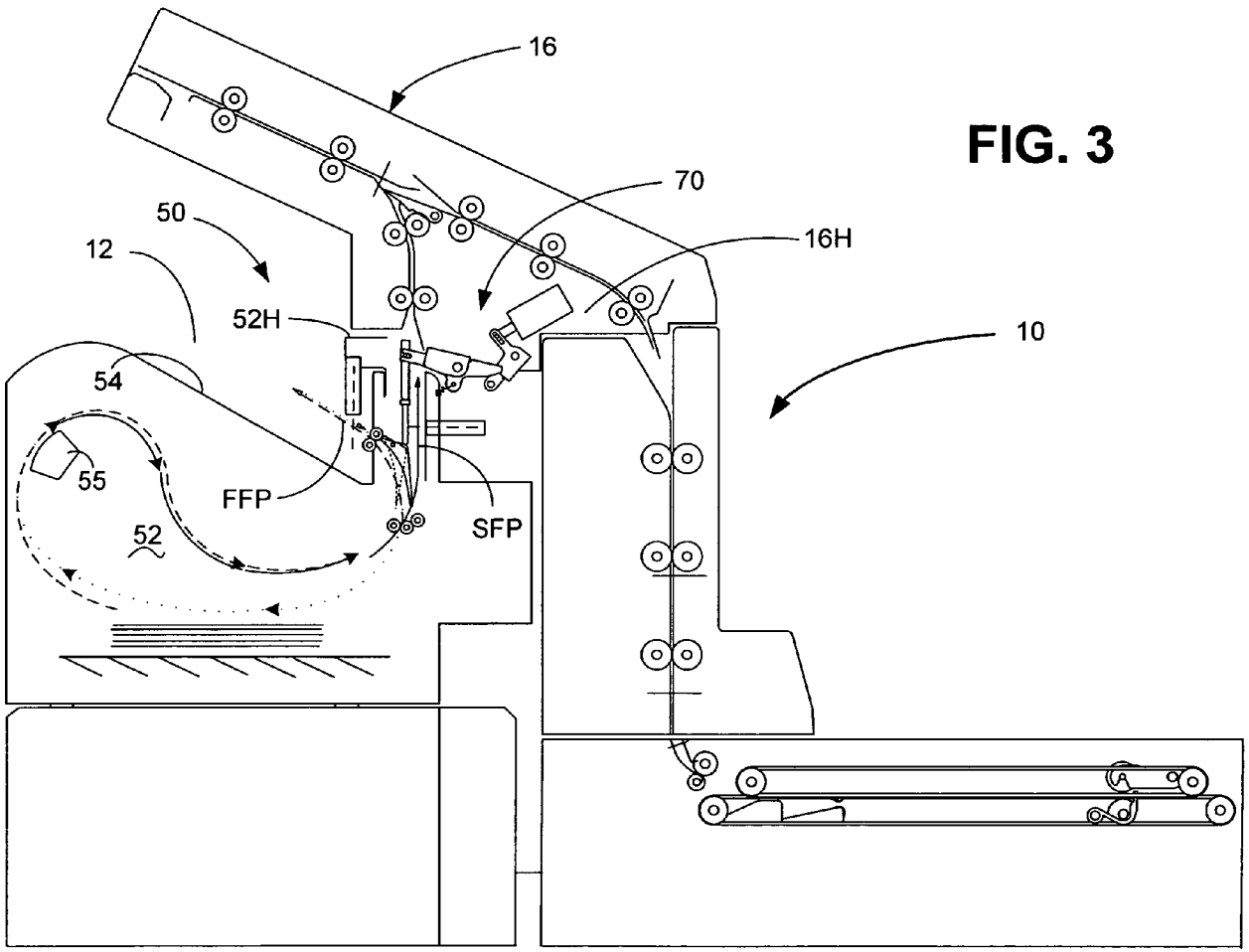
FIG. 3 is a broken-away side view of a print interface system in accordance with the teachings of the present invention, including a diverter and control mechanism for directing the feed path of duplex-printed content material.

To accommodate duplex printing, certain printers, such as the HP 4350 BW printer, feed duplex-printed pages to an output tray rather than to an accessory feed path. That is, these printers are preprogrammed by the OEM to feed duplex-printed pages to an upper output tray. In FIG. 3, an inventive print interface system 50 is shown, including various structural/control modifications to address the challenges associated with duplex printing. More specifically, the print interface system 50 is disposed between a printer 52 and a mailpiece inserter 10. The printer 52 includes multiple feed paths FFP, SFP for feeding sheet material 12 to an upper output/staging tray 54 or to a page buffer 16 similar to that described in the preceding paragraphs. A first feed path FFP manipulates sheet material 12 internally of the printer 52 such that, following a first operation (denoted by dashed lines in FIG. 3), the sheets 12 are passed or staged to the upper staging tray 54. The first operation involves passing the sheet material 12 past a print head 55 for printing on a first face surface of the sheet material 12.

Following a brief period (typically a fraction of a second) in the staging tray 54, the sheet material 12 reverses direction and re-enters the printer 52 such that a second face of the sheet 12 may pass the print head 55 for printing on the reverse face of the sheet material 12 (i.e., an operation denoted by the dotted line in the Figure), Even during the first print operation, other pages 12 are being handled/conveyed within the printer 52 such that several pages may pass the print head 55 to print on one face or an opposite face of the sheet 12. That is, to maximize throughput in the duplex printing mode, several sheets 12 may simultaneously be conveyed or handled internally of the printer 52. Furthermore, depending upon the sequence of print operations, two or more sheets may be printed on one face sheet before one of these same sheets is printed on its opposite face.

In view of the various print operations being performed while printing in the duplex mode, several difficulties must be understood and challenges overcome to ensure proper handling of the printed content material 12 at the print interface 50. For example, when the print interface system 50 is operative to feed sheets 12 to the mailpiece inserter 10, a second feed path SFP is established to forward printed content material to the page buffer 16. As a result, a controller or control algorithm must be employed to divert duplex pages to the page buffer 16 rather than to the upper tray 54. It will be recalled that the normal or preprogrammed print operation of the printer 52 calls for duplex-printed pages to be fed to the upper output tray 54.

Inasmuch as such duplex printed sheets 12 must be diverted to the mailpiece inserter 10 when producing mailpieces, the print interface system 50 includes a controllable/positionable diverter 56 having at least two positions. In a first position shown in FIG. 4*a*, sheets of material 12 are fed to the upper staging tray 54 in much the same manner as previously performed to reverse the direction of the sheets 12. That is, after printing on one face, the diverter 56 sends sheets 12, i.e., sheets which have now been printed on a single side, along the first feed path FFP to the upper staging tray 54. Following a second print operation associated with printing on the opposite face, the diverter 56 sends the sheets 12, i.e., sheets which have now been printed on both sides, along the second feed path SFP to the page buffer 16 (see FIG. 4*b*).

To acquire data/information concerning when a sheet 12 has passed various locations along the feed paths FFP, SFP, sheet sensors 60, 62 are located adjacent each of the paths FFP, SFP and orthogonal thereto to detect the presence or passage of a sheet 12. A first sheet sensor 60 is disposed proximal to a first printer opening 63, which outputs sheets 12 to the staging tray 54, and a second sheet sensor 60 is disposed immediately upstream of the diverter 56. More specifically, the first sheet sensor 60 optically detects the passage of the leading edge of a sheet 12 as it momentarily enters the staging tray 54 and subsequently reverses direction to re-enter the printer 52. The second sheet sensor 62 optically detects the passage of the trailing edge of a sheet 12 as it passes the diverter 56 into the page buffer 16 of the mailpiece inserter 10.

In operation, sheets of material 12 are printed on one side and are diverted to the upper staging tray 54. At this moment, the diverter 56 is spring-biased in a first direction, or to a position causing the sheets to follow the first feed path FFP, through the first printer opening 63 and past the first sensor 60. When the leading edge of each of the staged sheets 12 passes the optical beam 60B of the sensor 60, a staging signal 60S is issued to a controller 66 and an internal timer or clock 68 therein is set/started. Inasmuch as a plurality of sheets 12 may be staged into the tray 54 over the course of several seconds, many staging signals 64 may be issued thereby setting several timers 68 within the controller 66. Inasmuch as the second print operation, i.e., the operation which prints on the opposing face of the duplex-printed sheet, consumes a fixed period of time X (in seconds), it can be concluded that any identified sheet 12 which was first detected X seconds prior, i.e., by the first sensor 60, has now been printed on both face surfaces. Accordingly, the identified sheet 12 is ready to be passed to the page buffer 16 of the mailpiece inserter 10.

Figure 4B:
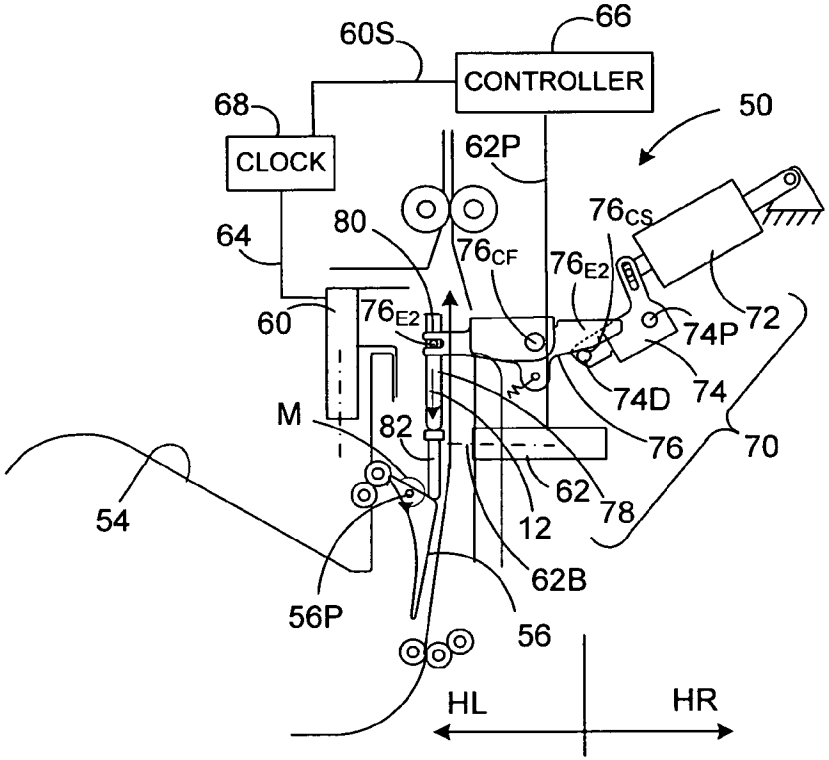
FIG. 4*b* is an enlarged view of the diverter in a second position for directing sheet material to the page buffer of the mailpiece inserter.
Figure 4A:
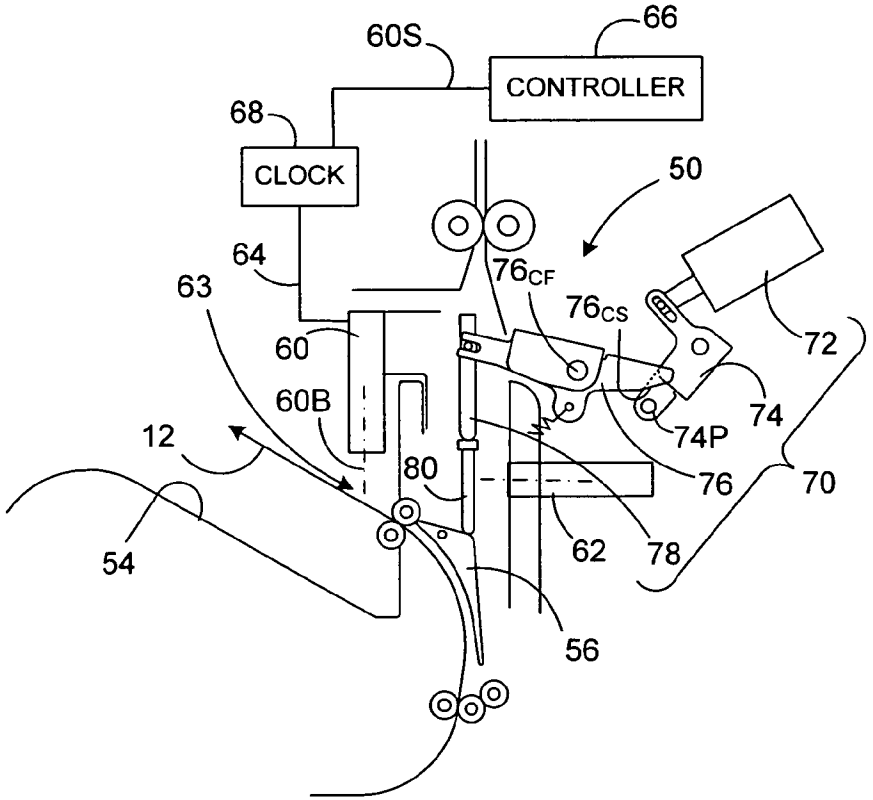
FIG. 4*a* is an enlarged view of the diverter in a first position for directing sheet material to an upper staging tray.

In FIGS. 4*a* and 4*b*, the controller 66 is responsive to the staging signal 60S issued by the first sensor to reposition the diverter 56 from a first position to a second position for directing sheets to the mailpiece inserter 10. Specifically, however, the controller 66 is operative to reposition the diverter 56 following a threshold period of time X from receipt of the staging signal. In the described embodiment the threshold period X is between 3.0 to 4.0 seconds, and, more precisely, between about 3.3 to about 3.7 seconds.

To ensure that the diverter 56 remains in its second position for a period of time sufficient to permit passage of a duplex-printed sheet 12, the second sensor 62 issues a position signal 62P to the controller 66. That is, when the trailing edge of a sheet 12 passes the optical beam 62B of the second sensor 62, the controller 66 is responsive to the position signal 62P to rapidly reposition the diverter 56 from the second position to its original or first position. Accordingly, the first and second sensors 60, 62 communicate with the controller 66 to ensure that a duplex-printed page 12 is ready to be diverted to the page buffer 16 and has safely past the mechanism of the diverter 56.

Referring to FIGS. 3 and 4*b*, the print interface system 50 includes a mechanism 70 for actuating the diverter 56. Furthermore, the mechanism 70 is adapted to permit separation and/or disengagement of the printer 12 relative to the page buffer 16 of the mailpiece inserter 10. In the described embodiment, the mechanism 70 includes a linear actuator 72, a bell crank 74, a lever arm 76 and a plunger 78. More specifically, the linear actuator 72 and bell crank 74 are mounted to a housing structure 16H (see FIG. 3) of the page buffer 16 while the lever arm 76 and plunger 78 are affixed to a bridge structure 52H (FIG. 3), i.e., a structure bridging the output openings (i.e., staging and accessory output areas) of the printer 52.

Inasmuch as the diverter 56 is rotationally spring-biased to a first position, the mechanism 70 is adapted to overcome the spring bias force, thereby repositioning the diverter 56 to its second position, i.e., for directing sheet material 12 to the page buffer 16 of the mailpiece inserter 10. Upon receiving a command signal from the controller 66, the actuator 72 retracts linearly to pivot the bell crank 74 in a counterclockwise direction about a pivot point 74P. As the bell crank 74 pivots, a displacement device 74D, e.g., a cylindrical pin, follows an arcuate path to engage a cam surface 76CS at a first end $\mathbf{76}_{E1}$ of the lever arm 76. Inasmuch as the lever arm 76 is pivot-mounted to the bridge structure 74 about a central fulcrum 76CF, the upward vertical motion of the pin 74P effects a downward vertical displacement of the lever arm 76 at its opposing second end $\mathbf{76}_{E2}$.

The downward displacement of the lever arm 76 is transferred to the plunger 78 by means of a slotted yoke/pin coupling 80 formed at the juncture of the second end $\mathbf{76}_{E2}$ of the lever arm 76 and the upper end of the plunger 78. Additionally, the downward motion of the plunger 78 is, in turn, transferred to an actuation pin 82 which engages the diverter 56. Finally, the actuation pin 82 engages a surface of the diverter 56 to effect a force couple or moment M about the pivot mount 56P of the diverter 56. The moment force M, therefore, alternately repositions the diverter 56 between its actuating or sheet diverting positions.

Inasmuch as the bell crank 74 and lever arms 76 are not positively coupled (i.e., the coupling-free interface defined by the interaction of a pin 74D and a cam surface $\mathbf{76}_{CS}$), these elements may be freely separated by the horizontal displacement of the printer 52 relative to the page buffer 16. That is, by separating the printer 52 and page buffer 16 horizontally, in the direction of arrows HL, HR, the print interface system 10 facilitates removal, replacement or repair of the printer 52 and/or printer components which may be accessible only by separating the components.

Parallel Feed Path for Conventional and Mailpiece Creation Modes

As discussed in the Background of the Invention, the printer must be controlled to send sheet material to a stacking tray when being operated as a conventional printing apparatus and to a downstream module of the inserter when being used to generate mailpieces. In addition to adapting the print interface for use in multiple modes, it is oftentimes desirable to minimize the impact on the external dimensions of the printer or sheet handling device, e.g., the height dimension, for ergonomic considerations and/or to minimize the overall space envelope occupied by the integrated sheet handling system.

Figure 5:
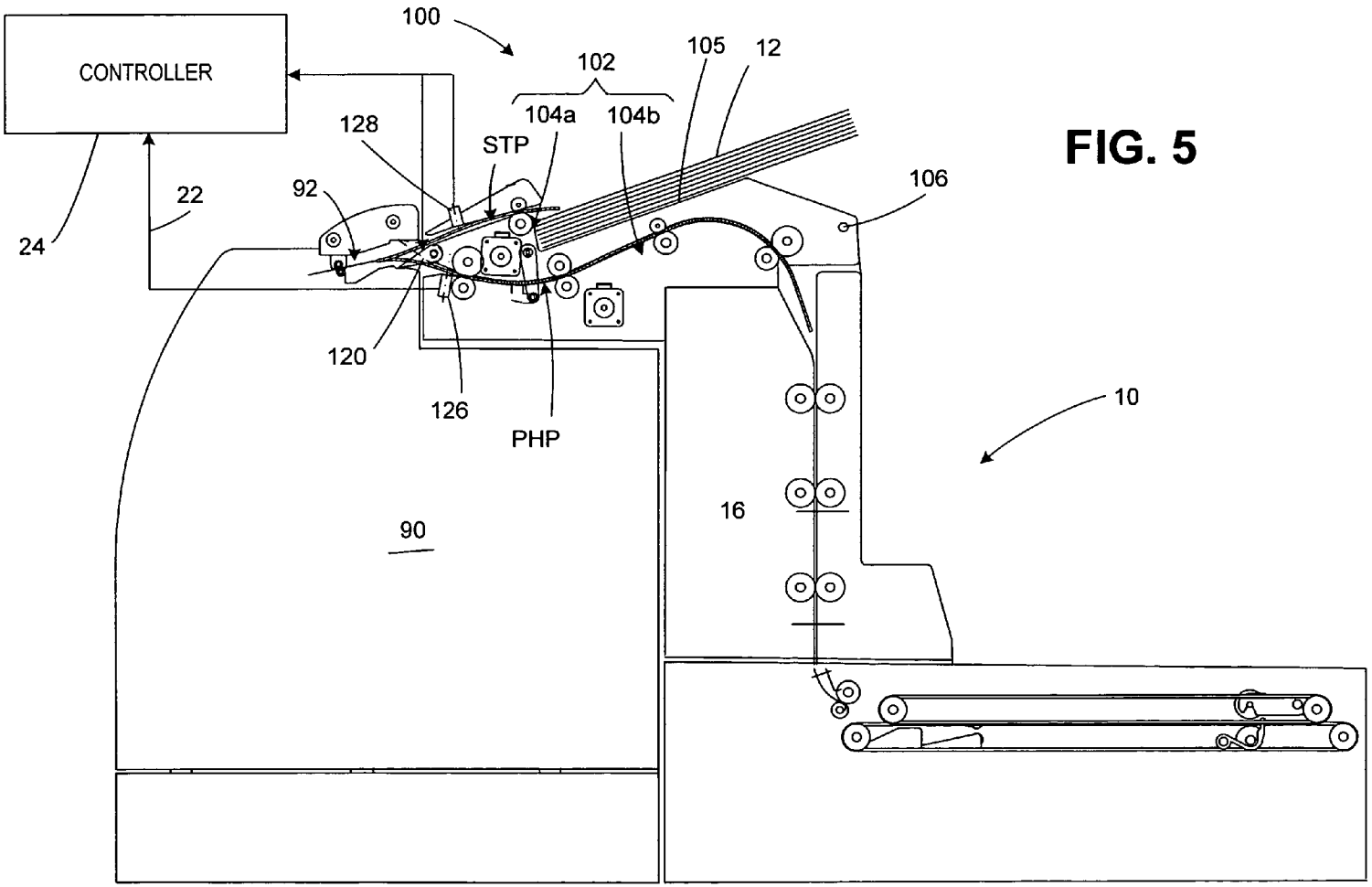
FIG. 5 is a broken away side view of a print interface system according to another embodiment of the invention, including a diverter and control mechanism for directing the feed path of content or sheet material.
Figure 6:
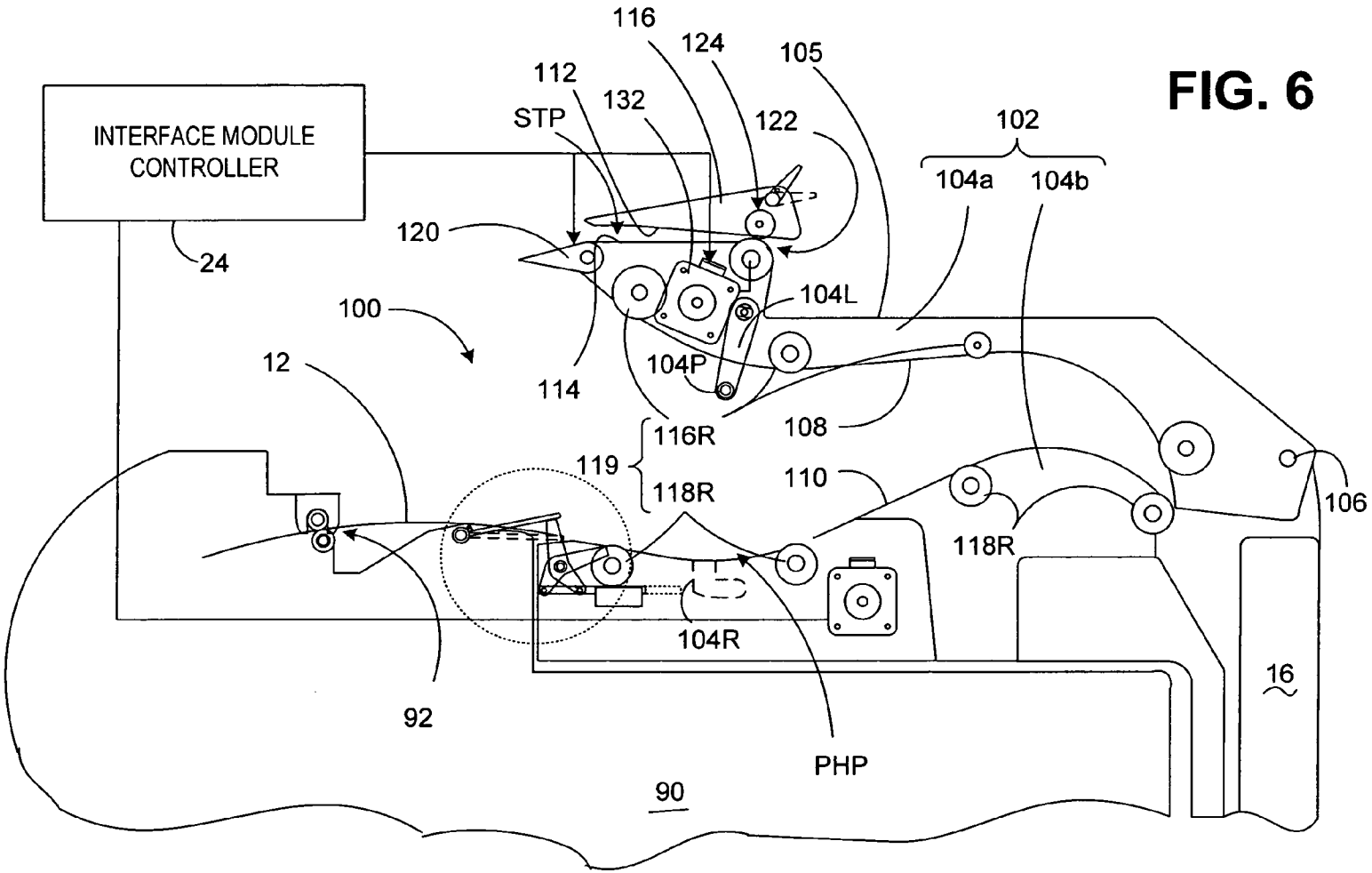
FIG. 6 is an enlarged side view of the print interface system shown in FIG. 5, including an interface module having a pivotable upper stacking tray and a lower housing segment which, in combination, define parallel feed paths for directing sheet material.

To accommodate multiple operating modes while maintaining a minimal space envelope, another embodiment of the print interface system is shown in FIGS. 5 and 6. Specifically, a printer 90 has a single output opening 92 for feeding sheet material 12. While such printer 90 has the advantage of predefined program code to accommodate duplex printing, i.e., without the requirement to stage sheet material to an output tray, a disadvantage relates to its inability to stack sheet material for conventional print operations. That is, the printer 90 lacks a dedicated output tray for stacking printed sheet material.

To overcome this and other potential disadvantages, the print interface system 100 includes an interface module 102 disposed proximal to the output opening 92 for diverting sheet material 12 along one of two feed paths PHP, STP. The first feed path PHP directs sheet material 12 to the page buffer 16 of the mailpiece inserter 10 while the second feed path STP directs sheet material 12 to a stacking tray 105. With respect to the first or paper handling feed path, the interface module 102 includes upper and lower housing segments 104*a*, 104*b* wherein the upper housing segment 104*a* is pivotally mounted to the lower housing segment about a pivot axis 106. The first feed path (also referred to as the page buffer path) PHP is defined by the combination of the upper and lower housing segments 104*a*, 104*b* and, more specifically, by a lower housing surface 108 of the upper housing segment 104*a* and an upper conveyor surface 110 of the lower housing segment 104*b*. Additionally, the upper and lower housing segments 104*a*, 104*b*, each include a plurality of rolling elements 116R, 118R projecting from the respective lower housing and conveyor surfaces 108, 110. The rolling elements 116R, 118R are aligned such that upon closure of the housing segments 104*a*, 104*b* (i.e., about the pivot point or axis 106), the rolling elements 116R, 118R define drive nips 119 to convey the sheet material 12 along the paper handling feed path PHP.

A spring-biased latching mechanism 104L is disposed in combination with the upper housing segment 104*a* to engage a recess 104R of the lower housing segment 104*b* for the purpose of securing the housing segments 104*a*, 104*b*. More specifically, a retention pin 104P is disposed at an end portion of the latching mechanism 104L and is spring biased to positively engage an L-shaped portion of the recess 104R. Additionally, the position of the drive nips 119 is maintained by the latching mechanism 104L.

The second feed path or stacking tray path STP is defined internally of or within the upper housing segment 104*b* and, more specifically, is disposed between a lower feed surface 112 and an upper guide surface 114 thereof. The lower feed surface 112 is disposed above the lower housing surface 106 and the upper guide surface 114 is defined by a wedge-shaped cap or cover 116. Additionally, the second feed path STP terminates in an opening 122 leading to the stacking surface 105 and includes a pair of nip rollers 1.24 proximal to the terminal end of the stacking path STP.

A repositionable diverter 120 is disposed upstream of the first and second feed paths PHP, STP to bifurcate the feed paths PHP, STP. As a result, the diverter 120 causes the content material 12 to follow one of the feed paths PHP, STP toward either the stacking tray 105 or to the page buffer 16 of the mailpiece inserter 10. In operation, the system controller 24 commands or requests content material 12 from the printer 90 in accordance with the throughput commands signals 30 (see FIG. 1). Depending upon the operational mode, i.e., whether the printer 90 is in the mailpiece creation mode or conventional printing mode, the controller 24 commands the diverter to assume one of two positions.

In the mailpiece creation mode, the diverter 120 is commanded to an upward position (depicted as dashed lines in FIG. 3) such that the sheet material 12 is directed along the paper handling path PHP and toward the page buffer 16. To minimize the space or size envelope of the page buffer, the print interface system 10 of the present invention takes advantage of the length of its paper handling feed path PHP. That is, inasmuch as the feed path PHP spans a length equal to the length of a sheet, the interface module 100 is adapted to define at least one of the page stations (e.g., page station 18*a*) of the page buffer 16. That is, a position sensor 126 is disposed in the paper handling feed path PHP of the interface module 100 and is operative to issue position signals 22 to the controller 24 of the mailpiece inserter 10. As described in the preceding section entitled "Printer Integration/Print Interface", this signal 22, in combination with other position signals 22 from each of the remaining page stations 18*b*, 18*c*, 18*d*, and 18*e*, may be used to derive throughput data indicative of the number of pages which can be accepted by the page buffer 16.

In the conventional printing operational mode, the repositionable diverter 120 is disposed to a downward position (depicted as solid lines in FIG. 5). To augment the transport of sheet material 12 along the sheet stacking path STP, sheet material 12 is sensed by an optical sensor 128 (see FIG. 5) to drive nips 124 to convey sheet material to the stacking tray 105. More specifically, the optical sensor 128 sends a signal to the controller 24 to drive a motor 132 (see FIG. 6) internally of the upper housing 104*a* to augment the transport of sheet material to the upper stacking tray.

The invention may also be adapted to a method for integrating a printer with a mailpiece inserter. More specifically, the pivotal mount of the upper and lower segments 104*a*, 104*b* enables the interface module 100 to define dual feed paths STP, PHP while maintaining a minimal height dimension, i.e., a low profile, and a minimal space or total length envelope. One of the feed paths direct sheet material 12 to the upper stacking tray 105 while the other feed path directs sheet material 12 to the page buffer 16.

By incorporation of a sensor, i.e., a position sensor 126 within the second or page buffer feed path PHP, the method provides an opportunity to optimally utilize the spatial envelop of the interface module 100. That is, the length of the page buffer feed path PHP may be utilized to function as one of the page stations of the page buffer 16. Accordingly, the requirement for increased height or length in the page buffer 16 to provide another page station may be eliminated.

Figure 7:
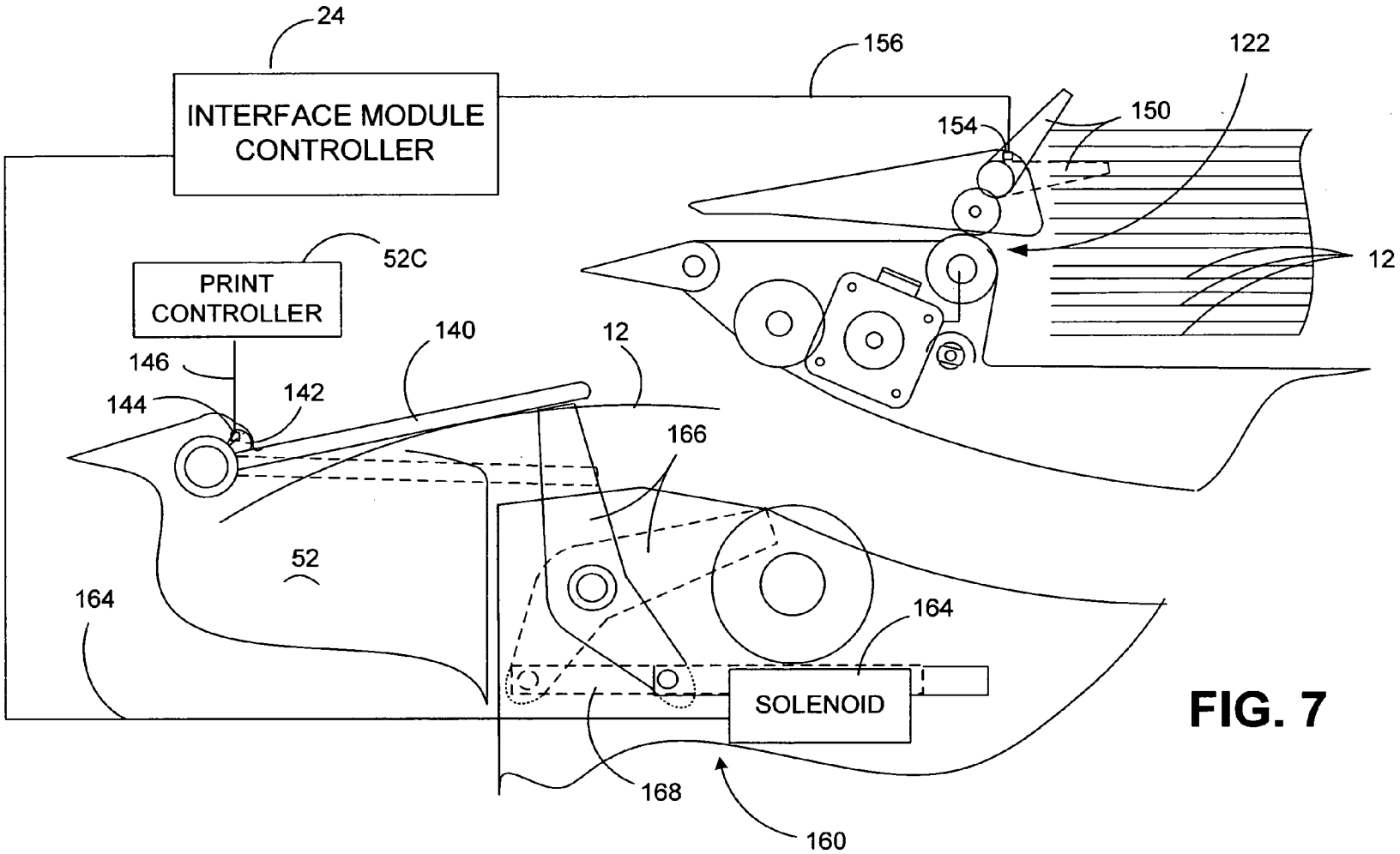
FIG. 7 is a broken away side view of the print interface system including a sensing mechanism for terminating print operations to the upper stacking tray when the tray is full to capacity.

Inasmuch as the print interface system 10 must be adapted to perform operations which are originally provided by the OEM, the interface module 100 is also adapted to include a mechanism for terminating print operations when the stacking tray 105 has been filled to capacity. More specifically, and referring to FIG. 7, the printer 52 as originally provided by the OEM, includes a stacking tray (not shown) which is removed to accommodate the interface module 100. When printed sheet material fills the stacking tray, a lever arm 140 is provided to terminate print operations. That is, when printed sheet material accumulates to a threshold level, the lever arm 140 pivots upward, i.e., from a first position (shown in dashed lines in FIG. 7) to a second position (shown in solid lines). Furthermore, the lever arm 140 includes a flag 142 to interrupt a first light sensor 144 when the lever arm 140 remains in position for a predetermined period of time, e.g., thirty (30) seconds. The light sensor 144 then issues a terminate print signal 146 to the printer to discontinue print operations.

To incorporate this same functionality within the interface module 100, a flag lever 150 is similarly provided at the output end or opening 122 of the stacking tray feed path STP.

More specifically, the flag lever 150 pivots upward, from a first position (shown in dashed lines) to a second position (shown in solid lines), to interrupt a second light sensor 154. When the flag lever 150 reaches a threshold rotational position, a signal 156 is issued to the controller 24 to terminate print operations. Inasmuch as the interface controller 24 is not in direct communication with the printer controller 52C, a stop mechanism 160 cooperates with the lever arm 140 of the printer 52 to discontinue or terminate print operations. More specifically, the interface controller 24 issues an actuation signal 162 to a linear actuator or solenoid 164 which is pivotally mounted to an actuation arm 166. Upon receipt of the actuation signal 162, a piston rod 168 of the solenoid 164 moves linearly to effect rotation of the actuation arm 166, i.e., in a counterclockwise direction from a first position (shown in dashed lines) to a second position (shown in solid lines). The actuation arm 166 engages the lever arm 140 to effect lift and rotation, i.e., as if the rotation were effected by the accumulation of sheet material. As such, the stop mechanism 160 simulates a "full stack" or "tray full" condition to terminate print operations.

In view of the foregoing, it will be appreciated that the above described configuration introduces a time delay with respect to terminating print operations. That is, the flag lever 150 actuates the light sensor 154 which, in turn, actuates the lever arm 140 and corresponding light sensor 144 through the stop mechanism 160. Further, the lever arm 140 must interrupt the light sensor 144 for a predetermined or threshold period of time, e.g., thirty (30) seconds, before print operations are terminated.

To improve the responsiveness of the interface module 100, it may be desirable to preposition the flag lever 150 and light sensor 154 so as to anticipate the required lag period or built-in time delay. That is, the flag lever 150 and corresponding light sensor 154 may be pre-positioned in advance such that additional sheet material may accumulate during the lag period. For example, if sheet material is output at a rate of one (1) sheet for every two (2) seconds, then the flag lever 150 may be advanced to trip the light sensor 154 such that fifteen (15) additional sheets may be added to the stacking tray 105 before reaching full capacity. Accordingly, during the thirty second (30) lag delay, fifteen (15) sheets may continue to be delivered or accumulate without exceeding the stacking tray capacity.

In summary, the print interface system which is low profile to facilitate handling of stacked sheet material. The print interface system is, furthermore, adapted to accommodate both conventional printing and mailpiece creation modes of operation. A low profile interface is affected by parallel feed paths, i.e., a stacking tray feed path and a sheet handling feed path, wherein sheet material is directed to one of two feed paths by a repositionable diverter. The print interface system, furthermore, includes an interface module having upper and lower housing segments wherein the upper housing segment is pivotally mounted to the lower housing segment to facilitate handling and feeding through the stacking tray and sheet handling feed paths. The interface module includes various other mechanisms to augment and duplicate the feeding of sheet material to the upper stacking tray.

It is to be understood that the present invention is not to be considered as limited to the specific embodiments described above and shown in the accompanying drawings. The illustrations merely show the best mode presently contemplated for carrying out the invention, and which is susceptible to such changes as may be obvious to one skilled in the art. The invention is intended to cover all such variations, modifications and equivalents thereof as may be deemed to be within the scope of the claims appended hereto.

The invention claimed is:

1. A print interface system for integrating a printer with a sheet handling device, the printer having an output opening for feeding sheet material, the print interface system including:

an interface module disposed proximal to the output opening for accepting the sheet material and having upper and lower housing segments, the interface module defining first and second feed paths, a first feed path for directing sheet material to a stacking tray and a second feed path directing sheet material to a downstream module of the sheet handling device, the upper housing segment of the interface module pivotally mounted to the lower housing segment to provide internal access to one of the first and second feed paths, the upper housing segment producing the first feed path to define a stacking path and including an output opening leading to the stacking tray, a pair of nip rollers proximal to the terminal end of the stacking path, a sensor for detecting sheet material fed along the stacking path, and a motor for driving the nip rollers to augment the conveyance of sheet material to the stacking surface; and a repositionable diverter for directing sheet material to one of the first and second feed paths and bifurcating the feed paths such that one feed path is disposed substantially above the other feed path.

2. The print interface system according to claim 1 wherein the upper housing segment defines an underside surface and the lower housing segment defines a conveyor surface, the underside and conveyor surfaces, in combination, defining one of the first and second feed paths.

3. The print interface system according to claim 1 wherein the upper and lower housing segments each include a plurality of rolling elements, and wherein the rolling elements of one housing segment oppose corresponding rolling elements of the lower housing segment to define drive nips for conveying sheet material along the second feed path.

4. The print interface system according to claim 1 wherein the interface module includes a latching mechanism for maintaining the relative positions of the upper and lower housing segments while the print interface system is in operation.

5. The print interface system according to claim 1 wherein the interface module feeds sheet material to a page buffer of a mailpiece inserter, and wherein one of the first and second feed paths is adapted for use as a page station of the page buffer.

6. The print interface system according to claim 5 wherein the sheet handling feed path includes a position sensor, the position sensor operative to issue position signals to a controller of the mailpiece inserter for determining the throughput thereof and for throttling an output of the printer.

7. The print interface system according to claim 1 wherein the upper housing segment defines the first feed path and includes an output opening leading to the stacking tray and further comprises a light sensor disposed proximal to the output opening of the stacking tray and a flag lever pivotally mounted to the upper housing segment, the flag lever rotating to a threshold rotational position and operative to interrupt the light sensor in response to sheet material accumulating in the stacking tray, the light sensor, furthermore, issuing a signal to the interface controller to terminate print operations when sheet material accumulates in the stacking tray to a threshold level.

8. The print interface system according to claim 7 wherein the printer includes a lever arm pivotally mounting to the output opening of the printer and a light sensor, the lever arm operative to interrupt the light sensor upon rotating to a threshold position, the light sensor, furthermore, operative to issue a terminate print operation signal to the printer when interrupted by the lever arm, and further comprising a stop mechanism, responsive to an actuation signal from the interface controller, for rotating the lever arm to interrupt the light sensor.

9. A mailpiece inserter comprising:

a printer operative to print sheet material;

a page buffer operative to receive the sheets of mailpiece content material from the printer; and a print interface system operative to integrate the printer with the page buffer, the print interface system including:

an interface module disposed proximal to the output opening for accepting the sheets of content material and having upper and lower housing segments, the interface module defining first and second feed paths, a first feed path for directing sheet material to a stacking tray and a second feed path directing sheet material to the page buffer, the upper housing segment of the interface module pivotally mounted to the lower housing segment to provide internal access to one of the first and second feed paths and defining an underside surface, the lower housing segment defining a conveyor surface such that the underside and conveyor surfaces, in combination, define a sheet handling feed path, a repositionable diverter for directing sheet material to one of the first and second feed paths;

an interface controller operative to control the page buffer, print interface system and the interface module, and a light sensor disposed proximal to an output opening of the stacking tray and a flag lever pivotally mounted to the upper housing segment, the flag lever rotating to a threshold rotational position and operative to interrupt the light sensor in response to sheet material accumulating in the stacking tray, the light sensor, furthermore, issuing a signal to the interface controller to terminate print operations when sheet material accumulates in the stacking tray to a threshold level.

10. The mailpiece inserter according to claim 9 wherein the diverter bifurcates the feed paths such that one feed path is disposed substantially above the other feed path.

11. The mailpiece inserter according to claim 9 wherein the upper and lower housing segments each include a plurality of rolling elements, and wherein the rolling elements of one housing segment oppose corresponding rolling elements of the lower housing segment to define drive nips for conveying sheet material along the sheet handling feed path.

12. The mailpiece inserter according to claim 9 wherein the sheet handling feed path includes a position sensor, the position sensor operative to issue position signals to a controller of the mailpiece inserter for determining the throughput thereof and for throttling an output of the printer.

13. The print interface system according to claim 9 wherein the printer includes an a lever arm pivotally mounting to the output opening of the printer and a light sensor, the lever arm operative to interrupt the light sensor upon rotating to a threshold position, the light sensor, furthermore, operative to issue a terminate print operation signal to the printer when interrupted by the lever arm, and further comprising a stop mechanism, responsive to an actuation signal from the interface controller, for rotating the lever arm to interrupt the light sensor.

* * * * *